US007069726B2

(12) United States Patent
Frutschi

(10) Patent No.: US 7,069,726 B2
(45) Date of Patent: Jul. 4, 2006

(54) THERMAL POWER PROCESS

(75) Inventor: Hans Ulrich Frutschi, Riniken (CH)

(73) Assignee: ALSTOM Technology Ltd., Baden (CH)

( * ) Notice: Subject to any disclaimer, the term of this patent is extended or adjusted under 35 U.S.C. 154(b) by 0 days.

(21) Appl. No.: 10/939,375

(22) Filed: Sep. 14, 2004

(65) Prior Publication Data

US 2005/0072154 A1 Apr. 7, 2005

Related U.S. Application Data

(63) Continuation of application No. PCT/EP03/50053, filed on Mar. 11, 2003.

(30) Foreign Application Priority Data

Mar. 14, 2002 (CH) ..... 0443/02

(51) Int. Cl.
*F02C 1/00* (2006.01)

(52) U.S. Cl. ..... 60/772; 60/39.181; 60/39.511

(58) Field of Classification Search ..... 60/791, 60/39.17, 39.181, 39.182, 39.183, 39.53, 60/39.59, 772, 775, 774, 39.511
See application file for complete search history.

(56) References Cited

U.S. PATENT DOCUMENTS

| | | | | |
|---|---|---|---|---|
| 3,006,146 A | | 10/1961 | Jackson | |
| 4,261,166 A | * | 4/1981 | Mayrhofer | 60/780 |
| 4,751,814 A | * | 6/1988 | Farrell | 60/39.183 |
| 4,922,709 A | * | 5/1990 | Hendriks | 60/39.183 |
| 5,628,183 A | * | 5/1997 | Rice | 60/39.182 |
| 5,687,559 A | * | 11/1997 | Sato | 60/39.182 |
| 5,810,564 A | | 9/1998 | Kakovitch | |
| 6,148,602 A | * | 11/2000 | Demetri | 60/775 |
| 6,244,039 B1 | * | 6/2001 | Sugishita et al. | 60/39.182 |

(Continued)

FOREIGN PATENT DOCUMENTS

DE 36 05 466 A1 8/1987

(Continued)

OTHER PUBLICATIONS

Search Report from CH 0443/02 (Jun. 7, 2002).

(Continued)

*Primary Examiner*—William Rodriguez
(74) *Attorney, Agent, or Firm*—Cermak & Kenealy, LLP; Adam J. Cermak

(57) ABSTRACT

In a power generation unit, especially in a gasturbo group, a gaseous process fluid is guided in a closed cycle. The gaseous process fluid flows through a compression device (1), a heater (6) and an expansion device (2), especially a turbine. Downstream from the expansion device at least one heat sink (11, 13) is arranged in which the gaseous process fluid is cooled before it is returned to the compressor device (1). At least one heat sink includes a waste heat steam generator in which an overheated amount of steam (26) is generated that is added to the compressed gaseous process fluid. Together with the gaseous process fluid the steam flows through the heater (6) if necessary and is expanded together with it. The expanded steam condenses in the waste heat steam generator (11) and another heat sink (13); the condensate is processed in a filter (16) and is returned to the waste heat steam generator (11) under pressure via a feed pump (18). Due to the closed process any kind of process fluid and process filling for controlling performance can be used.

27 Claims, 2 Drawing Sheets

U.S. PATENT DOCUMENTS

| | | | | |
|---|---|---|---|---|
| 6,260,347 | B1 * | 7/2001 | Bronicki et al. | 60/774 |
| 6,260,348 | B1 * | 7/2001 | Sugishita et al. | 60/39.12 |
| 6,408,612 | B1 * | 6/2002 | Hannemann et al. | 60/39.12 |
| 6,412,285 | B1 * | 7/2002 | Ranasinghe et al. | 60/782 |
| 6,543,214 | B1 * | 4/2003 | Sasaki et al. | 60/39.5 |
| 6,637,183 | B1 * | 10/2003 | Viteri et al. | 60/39.182 |
| 2003/0037534 | A1 * | 2/2003 | Sugishita et al. | 60/39.182 |
| 2003/0070415 | A1 * | 4/2003 | Hatamiya et al. | 60/39.511 |
| 2004/0103637 | A1 * | 6/2004 | Maisotesenko et al. | 60/39.59 |
| 2005/0056001 | A1 * | 3/2005 | Frutschi et al. | 60/39.182 |

FOREIGN PATENT DOCUMENTS

| | | | |
|---|---|---|---|
| DE | 36 19 661 | A1 | 12/1987 |
| DE | 100 55 202 | A1 | 2/2002 |
| WO | 01/90548 | A1 | 11/2001 |
| WO | 03/076769 | A1 | 9/2003 |

OTHER PUBLICATIONS

Search Report from PCT/EP03/50053 (Jun. 30, 2003).
IPER from PCT/EP03/50053 (Jul. 7, 2004).

* cited by examiner

THERMAL POWER PROCESS

This application is a Continuation of, and claims priority under 35 U.S.C. § 120 to, International application number PCT/EP03/50053, filed 11 Mar. 2003, and claims priority under 35 U.S.C. § 119 to Swiss application number 2002 0443/02, filed 14 Mar. 2002, the entireties of both of which are incorporated by reference herein.

BACKGROUND OF THE INVENTION

1. Field of the Invention

The present invention concerns a thermal power process. It furthermore concerns a device suitable for carrying out a cyclic process as well as a power generation unit that utilizes the device based on the process of the invention.

2. Brief Description of the Related Art

Power generation units with closed processes are known per se in the state of the art. Examples are the two-phase steam turbine processes. Also known and often technically realized are processes in which a gaseous performance fluid initially is compressed, heated and then expanded in an engine accompanied by thermodynamic performance. Then the fluid is cooled again, compressed and returned to the compression. Examples are the realization of the closed Carnot Process in the Stirling engine. Another example that was very prominent in the past is the closed Ackeret-Keller process in which especially a gasturbo component group is operated in a closed cycle. The advantage of this process is the fact that the line can be controlled through the charging degree of the process, i.e., through the variable admission pressure prior to the compressor and the independent selection of the performance medium. A disadvantage per se is the fact that external heat must be supplied to the cycle process, which means that such a gas turbine with a closed process is limited with regard to the turbine entry temperatures. Consequently only a small pressure ratio in conjunction with lower effectiveness and performance potential can be realized, if a meaningful quantity of heat is to be supplied through the heat exchange. Another option would be to use a large number of costly intermediate cooling stages in the compressor. In any case the compressor temperature must be clearly below the maximum realizable process temperature in order to arrive at a technically meaningful realization. If there is a high pressure ratio, the waste heat utilization based on recuperating the enthalpy streams exiting the turbine are limited because the compressor end temperature quickly exceeds the turbine exit temperature with increasing pressure ratio. Nevertheless gas turbines with closed cycles for low temperature utilization recently have received more attention again. Other closed cycle processes and energy generation units that work in a closed process environment are increasingly interesting from a technical point of view again as well.

DE 36 05 466 describes a closed gas turbine unit in which an amount of steam is generated and introduced into the process fluid. The steam is introduced between two expansion stages. This means that the generated steam only supports a part of the performance generating expansion. DE 36 05 466 does not use the steam generation for utilizing the process waste heat.

SUMMARY OF THE INVENTION

Therefore one aspect of the present invention is to provide a thermal power process as described in the introduction that avoids the disadvantages of the state of the art and that especially allows for utilizing the process waste heat even with limited upper process temperatures and high pressure ratios.

Another aspect of the present invention therefore is to at least recuperate part of the heat to be dissipated following the expansion and to return it to the cycle process in a power generation unit that primarily works with a gaseous process fluid that is heated up in the heat exchange prior to the expansion process. This, taking the given limitations of the upper process temperature into account, is not possible by increasing the specific enthalpy of the compressed process gas but rather by adding another enthalpy stream in the form of a medium that is heated by the process waste heat. Important is the fact that the primary process fluid does not undergo any phase alterations during the change in thermodynamic state while the supplementary medium undergoes a two-phase process so that it condenses following the expansion and is separated from the gaseous primary process fluid in this manner. The liquefied supplementary medium is returned to high pressure, is heated using the waste heat to be removed from the process, evaporated and, if necessary, overheated. As a cooling agent it absorbs heat during a heat sink of the process and is added to the compressed primary process fluid prior to the expansion, depending on the present thermodynamic state of the media, either upstream or downstream of the heater for the primary process fluid. Both media are expanded afterwards, optionally while delivering thermodynamic performance. In order to close the cycle process, heat must be removed from the expanded performance medium and a large part of the steam is condensed which results in the closing of the cycle of the supplementary fluid as well. In order to realize the cycle process it furthermore is advantageous to arrange at least a second heat sink upstream from the first compression process in order to define the temperature at the compressor entry as low as possible.

From a global point of view the process that the primary cycle medium undergoes initially is a compression of a first thermodynamic state to a second thermodynamic state, a change in thermodynamic state from the second thermodynamic state to a third thermodynamic state during which the primary process medium is supplied with heat, a change in thermodynamic state from the third thermodynamic state to a fourth thermodynamic state during which the primary process medium is expanded and a change in thermodynamic state in which the process medium is returned to the first thermodynamic state due to heat dissipation. This does not yet provide any information on the course of the changes in thermodynamic state that in fact is not primarily significant for the invention but rather is determined based on how the special process is realized from a technical point of view. This means the compression and expansion, at least that of the theoretical cycle process, can be isothermal or quasi-isothermal or isotropic, for example, or approximately isotropic, and the heat supply and dissipation is isochoric or isobar. In reality the process is determined by what technical means are being used. This does not provide perfect theoretical changes in thermodynamic state as they are described. Ideally the pressure of the process fluid is identical for the first and fourth thermodynamic state and for the second and third thermodynamic state. In reality there are of course streaming pressure losses when streaming through lines and heat transfer devices as well as pressure loss due to adding heat to the streaming fluid. These are not intended total pressure changes as they are due to expansion or compression. Rather, these are inevitable pressure changes and especially total pressure losses. Since total pressure changes that occur in the real process during the change in thermodynamic state from the second thermodynamic state to the third thermodynamic state and from the fourth thermodynamic state to the first thermodynamic state are not desired and are kept as low as possible, these changes in thermodynamic state mainly are considered to be isobar or quasi-isobar in this context.

Depending on the existing temperature conditions the generated steam is added to the primary process fluid either following the heat supply but prior to the expansion or wholly or partially prior to or during the heat supply to the primary process fluid and heat is added to this steam together with the primary process fluid. It also is possible to add a part of the steam to the primary process medium during the expansion from the third to the fourth thermodynamic state.

In one embodiment of the thermal power process embodying principles of the present invention, the process fluid is being cooled during the compression. In another embodiment embodying principles of the present invention, heat is supplied to the process fluid during the expansion. If the design is accordingly, at least approximate isothermal changes in thermodynamic state can be realized.

Another aspect of the present invention can include that the primary process fluid and the steam provide thermodynamic performance during the expansion from the third to the fourth thermodynamic state, especially in a power engine.

The complete, closed process in principle allows the choice of any process fluid. Nonetheless the process is especially easy to handle when non-toxic media are used and in particular when air is used as a primary process fluid and water is used as a supplementary two-phase fluid.

In a device for carrying out the thermal power process according to the principles of the present invention, at least one compression medium is arranged for the primary performance fluid, downstream from it at least one medium is arranged for supplying heat, especially a heat exchanger through which the process fluid streams from the secondary side, downstream from it at least one expansion medium is arranged, furthermore at least one steam generator as a first heat sink is arranged downstream from the expansion medium. Process fluid streams through the steam generator from the primary side with the process fluid cooling off. When the cooling of the process fluid reaches the dew point of the contained steam, the condensation of the steam commences and continues with further cooling. This causes the partial pressure of the steam and thus the dew point to sink with the overall pressure remaining constant. Contrary to the change in thermodynamic state in the Clausis-Rankine cycle process the condensation of the steam is not isobar and isothermal but rather occurs at a temperature that corresponds to the partial pressure of the steam. The advantage is that the condensation heat of the condensate that is separated with a higher partial pressure occurs at a temperature level at which this heat can be used for pre-heating the condensate that is returned to the secondary side of the steam generator. In an exemplary embodiment at least one additional heat sink is arranged downstream from the first heat sink to especially lower the temperature of the first thermodynamic state as low as possible and also to lower the remaining steam content in the primary process fluid as much as possible. Furthermore this is where the second heat sink for defining a process temperature is especially suitably arranged in order to define the lowest process temperature at this point that is determined by the temperature of the cooling agent, such as cooling water. Downstream from the water sink or water sinks or in their flow path for the primary process fluid, devices for separating the resulting condensate are arranged. Furthermore there are means, especially a feed pump, for transporting the condensate to the secondary side of the steam generator as well as means for supplying the generated steam downstream from the compression means and upstream from at least one expansion means. It should be noted that for the purpose of the present invention the side of the heat exchanger from which the heat is transferred is always called the primary side. The side to which the heat is transferred is always called the secondary side. In an embodiment of the device the compression means have at least one intermediate cooler or means for supplying fluid drops into the process fluid that flows through the compression means. These drops evaporate during the compression process and cool the compression means on the inside. Both measures are suitable to realize at least an approximate isothermal or quasi-isothermal compression. In the same manner means for supplying heat to the process fluid can be arranged within the expansion means or between at least two compression means. If the embodiment is suitable, at least one approximate isothermal expansion process can be realized. When arranging an intermediate cooler the possible condensation of residual moisture at the compressor entry in the primary performance medium must be taken into consideration. The described heat supply to the performance fluid can be used to maintain the temperature level available for generating steam at a sufficient level when there is a high pressure ratio of the process and a limited upper process temperature in order to ensure that the available steam is not overheated much. As an alternative the steam is supplied to the primary process fluid at reduced pressure following a partial expansion of the primary process fluid if the available temperature level is insufficient to make an at least somewhat overheated amount of steam on the upper process pressure available.

Especially at least one expansion means is a power engine in which the primary process fluid and at least a part of the steam are expanded using thermodynamic performance. An example is a power engine that acts as an expansion means that has at least one machine that acts as a compression means and/or a sink, all of them arranged on a mutual shaft.

One exemplary means for supplying heat to the process fluid is a heat exchanger that is connected to a heat generator on the primary side or through which the waste gas of a gas turbine flows from the primary side. Possible heat generators are especially charged furnaces that work with overpressure. The charge can result in a decrease of the component size and the heat transmission in the heat exchanger can be intensified on the primary side. In another exemplary embodiment the means for supplying steam are arranged upstream from the first heat supply means, which further intensifies the heat transmission in the heat exchanger on the secondary side as well.

In one exemplary embodiment the device has means that allow the changing of the pressure level of the entire process and consequently the amount of fluid in circulation. This provides an especially practical possibility for varying the performance of machines that function based on the thermal power process according to the invention. In such a machine the pressure ratio of the process remains constant for the most part, for example, which is why all machine components are operated close to the concept point, even with partial loads. In addition, it is possible to adjust the counterpressure of the expansion means, i.e. the low process pressure, so that the steam does not have any moisture during the expansion process even with a comparatively low upper process temperature.

A shunt line with a blocking and/or throttle device can advantageously be arranged downstream from the compression means through which compressed performance medium can be transported directly to the low-pressure portion of the device in accordance with the invention. This is important when the sink that is coupled to the power engine that acts as an expansion medium, displays quick load reductions, for example the load shedding of a generator. In this case the compressed process fluid is directly moved to the low-pressure portion of the thermal power unit.

Turbo compressors can be used as compression means and turbines can be used as expansion means, especially when high mass flow rates and thus continuously working machines are required for high performance output. However, it also is easily possible to use propeller compressors and—expanders or piston machines and other types that are known to one skilled in the art. Especially in the case of very high-pressure conditions a suitable serial connection of turbo and displacement machines is quite practical.

An exemplary embodiment of a thermal power unit for realizing the process in accordance with principles of the present invention is a gas turbo group with a closed cycle and in which downstream from a last turbine at least one waste heat steam generator is arranged as a first heat sink. Also downstream from it one or several additional heat sinks are arranged in which steam contained in the process fluid is condensed and separated. A boiler feed pump transports the resulting condensate into the waste heat steam generator where an optionally overheated amount of steam or a saturated steam is generated. The generated steam is returned to the performance fluid on the high-pressure side of the closed gas turbine, expanded, cooled and condensed in the turbine. To this extent such a machine is similar to a conventional STIG machine that is known per se. Nonetheless known STIG machines work in an open cycle and have a correspondingly large water consumption rate. The closed gas turbine in accordance with the invention recirculates the water. This can be accomplished easily within the low pressure part of the thermal power unit is operated under hyperbaric pressure. Already above the ambient temperature a main part of the contained steam is separated from the gas cycle. The pressure in the low-pressure part of the thermal power unit, i.e. during the fourth and first thermodynamic state, ranges above 5 bar, for example at 10 bar, in an exemplary embodiment. Low pressure in the range between 5 and 10 bar proves to be especially advantageous with regard to the condensation temperatures, the performance density and the required dimensions of the components. The smaller streaming cross sections on one hand are favorable with regard to stability but on the other hand they require increasing process pressure and thus stronger dimensions in order to provide the necessary stability. The specified pressure range also proves to be a favorable compromise. The higher temperature level of the condensation makes it possible to use the condensation heat in the steam generator. In addition, the largely free setting of the counterpressure of the turbine allows the setting of conditions with which the exergetic potential of the steam can always be utilized optimally without generating any significant moisture in the turbine, even if the pressure ratio is almost constant, the available heat varies strongly and the upper process temperatures vary. In addition, it is possible to freely select the performance media with regard to the performance gas as primary process medium and with regard to the medium used for the steam generation, which does not necessarily have to be water in the closed process. A gas turbine working with the process in accordance with the invention can be optimally adjusted to different conditions and can especially favorably be used for low temperature utilization.

A process in accordance with principles of the present invention allows for an advantageous realization of a power generation unit in which an open cycle gasturbo group is followed by a thermal power unit in accordance with the invention. In general the design of such a unit can be substantially simpler than a conventional water-steam cycle used for wastewater utilization and, as explained above, is especially suitable to handle strongly fluctuating waste heat.

BRIEF DESCRIPTION OF THE DRAWINGS

The invention will be explained in more detail based on the exemplary embodiments illustrated in the drawings. In particular.

The exemplary embodiments that are shown only present a small instructive section of the invention described in the claims.

DETAILED DESCRIPTION OF EXEMPLARY EMBODIMENTS

Figure 1:
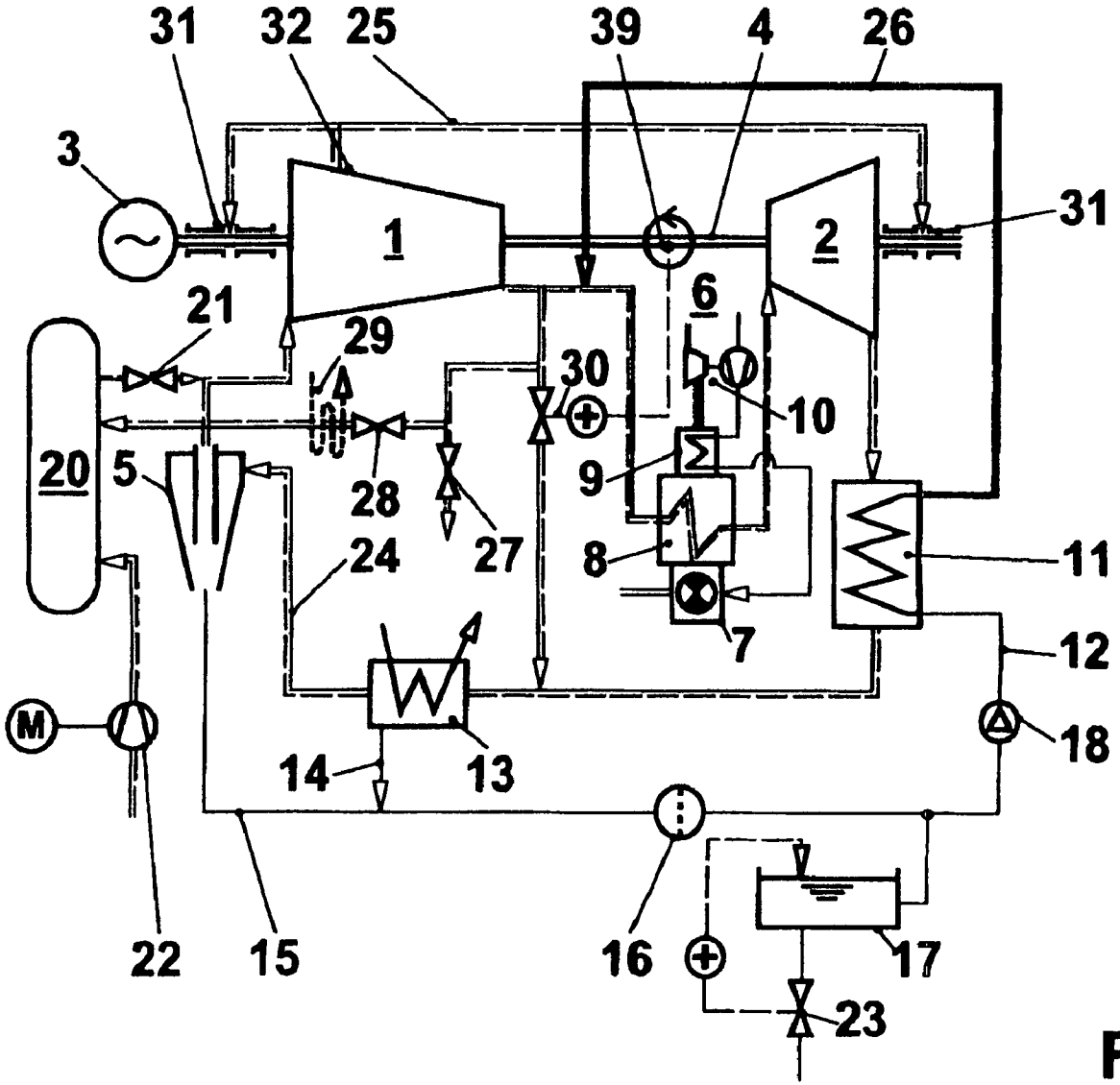
FIG. 1 shows a first power unit that operates based on the thermal power process according to the invention.

FIG. 1 shows a first embodiment of a power generation unit that operates based on the thermal power process in accordance with the invention. The embodiment that is shown is based on a closed gasturbo group. A compressor 1, a turbine 2, and a sink 3 are arranged on a mutual shaft 4. The compressor 1 as compression means compresses a gaseous primary process fluid, in the most simple form air, in a closed process to an upper process pressure. It is also possible to compress any other gas. For example, helium cycles provide advantages and have been realized for quite some time. Since it is a closed system, the starting pressure of the process fluid can clearly deviate up or down from the ambient pressure and above all can be a multiple of the ambient pressure. The compressed process fluid flows through means for supplying heat, especially a heat transfer medium, heat exchanger 6, on the secondary side. On the primary side it is connected to a charged combustion medium. A compressor of a waste gas load group 10 transports air under pressure through the secondary side of a preheater 9 to a combustion means, burner 7. When fuel is burnt, a hot flue gas is generated there that initially flows over the primary side of the hat exchanger surfaces 8 of the heater 6 and passes heat to the process fluid on the secondary side. The cooled off flue gas continues to flow through the pre-heater 9 on the primary side and heats the combustible air before it flows off to the surroundings through the turbine of the waste gas load group 10. It is possible to utilize residual heat at least partially for preheating the fuel. The charging of the combustion device reduces the size and allows the use of smaller heat exchangers. The heated and charged process fluid flows through turbine 2 while discharging and providing thermodynamic performance with the turbine acting as an expansion means and power machine and drives compressor 1 and its sink, generator 3 via the shaft 4. The expanded primary process fluid flows through two heat sinks 11 and 13 and is completely returned to the compressor, which closes the cycle. In order to carry out the thermal power process in accordance with the invention the first heat sink 11 is a waste heat steam generator. In the waste heat steam generator 11 a feed water mass flow 12 supplied by a feed pump 18 is heated, evaporated and at least somewhat overheated. This steam 26 is supplied to the secondary side of the heater 6 upstream into the compressed primary process fluid and, together with the process fluid, flows through the heater 6. Depending on the temperature of the live steam 26 it of course can be supplied to the primary process fluid downstream or within the means. The steam also flows through the turbine 2 providing thermodynamic performance. Downstream from the turbine at least part of the heat contained in the expanded fluid is used for generating steam in the waste heat steam generator. Due to the high partial pressure of the steam in the expanded process fluid the steam is condensed at a comparatively high temperature so that the condensation heat of the condensate separated at a high partial pressure is directly usable in the waste heat steam generator again. The partial pressure of the steam sinks with increasing condensate separation. That also applies to the dew point temperature. Downstream from the waste heat steam generator a second heat sink 13 follows through which cooling water 19 flows from the secondary side and in which the process fluid is further dehumidified. The second heat sink defines the lower process temperature of the thermal power process. When the primary process fluid is below pressure on the low-pressure side of the system, the separation of the water can be especially efficient. At a pressure of 5 to 10 bar and a temperature of the heat sink of 20° C. to 40° C., the residual humidity is between 1.5 and 9.5 grams water per kilogram air, for example. Condensate 14 is returned to the feed pump 18 through a filter 16 or a different treatment mechanism that is necessary. This closes the water cycle. A condensation water reservoir 17 is used as an intermediate reservoir for the water. The dehumidified primary process fluid 24 is supplied back to the compressor through an additional separator, cyclone 5. There, condensate 15 that is separated again, if necessary, also is returned to the water-steam cycle. Since the water-steam cycle is completely closed, no water is used. The process in accordance with the invention thus allows for media other than water to be used for generating steam, especially toxic media. Examples are especially organic cooling agents such as Frigon, Freon or ammoniac that are especially suitable for explicit low temperature use. Especially in a case like this it is important to prevent the medium that might be under hyperbaric pressure on the low-pressure side from exiting. During operation shaft seals 31 are supplied with blocking air 25 from a bleed location 32 of the compressor. In case of a primary process fluid other than air and/or a toxic or otherwise harmful medium in the two-phase process, an independent blocking medium system must be available during standstill as well. In the power generation unit that is shown and in which air is the primary process medium and water is used in the two-phase process, the cycle is filled from an air reservoir 20 via a throttle device 21 according to the required performance. The air compressor is charged with ambient air with a compressor 22. For the purpose of reducing the performance in the long-term, compressed air is moved back into the reservoir 20 either via a backstream throttle 28 and a backstream cooler 29 or into the environment via a blocking and throttle device 27. The performance can be controlled very efficiently due to the variable cycle charging which manifests itself in a variation of the low-pressure side pressure of the cycle. With it the unit is also operated at partial capacity with a concept pressure ratio while the mass stream of the surrounding cycle medium varies proportionately to the gas density. When the cycle is charged with ambient air, additional moisture is introduced into the cycle that is partially separated when the partial pressure is increased. The reservoir 17 therefore has a level control that opens a drain valve 23 when a certain fill level is reached. A power generation unit as described of course must react quickly to sudden load losses in order to avoid damaging overspeed. This is why a speed counter measuring device 39 is arranged which acts on a shunt device 30 when a certain torque is exceeded and discards part of the compressed process fluid or the entire compressed process fluid directly into the lower pressure part. In an emergency shutdown of the unit blocking and throttle devices 27 and/or 30 can be opened, which influence the unit's performance immediately. Intervention in the combustion fuel supply of the burner 7 on the other hand takes more time due to the slow heater 6.

The process in accordance with the invention of course can also be realized with a multi-shaft gasturbo group. Of course it is possible to easily arrange a cooling process during the compression process or heat supply during expansion in a manner that is known per se.

Figure 2:
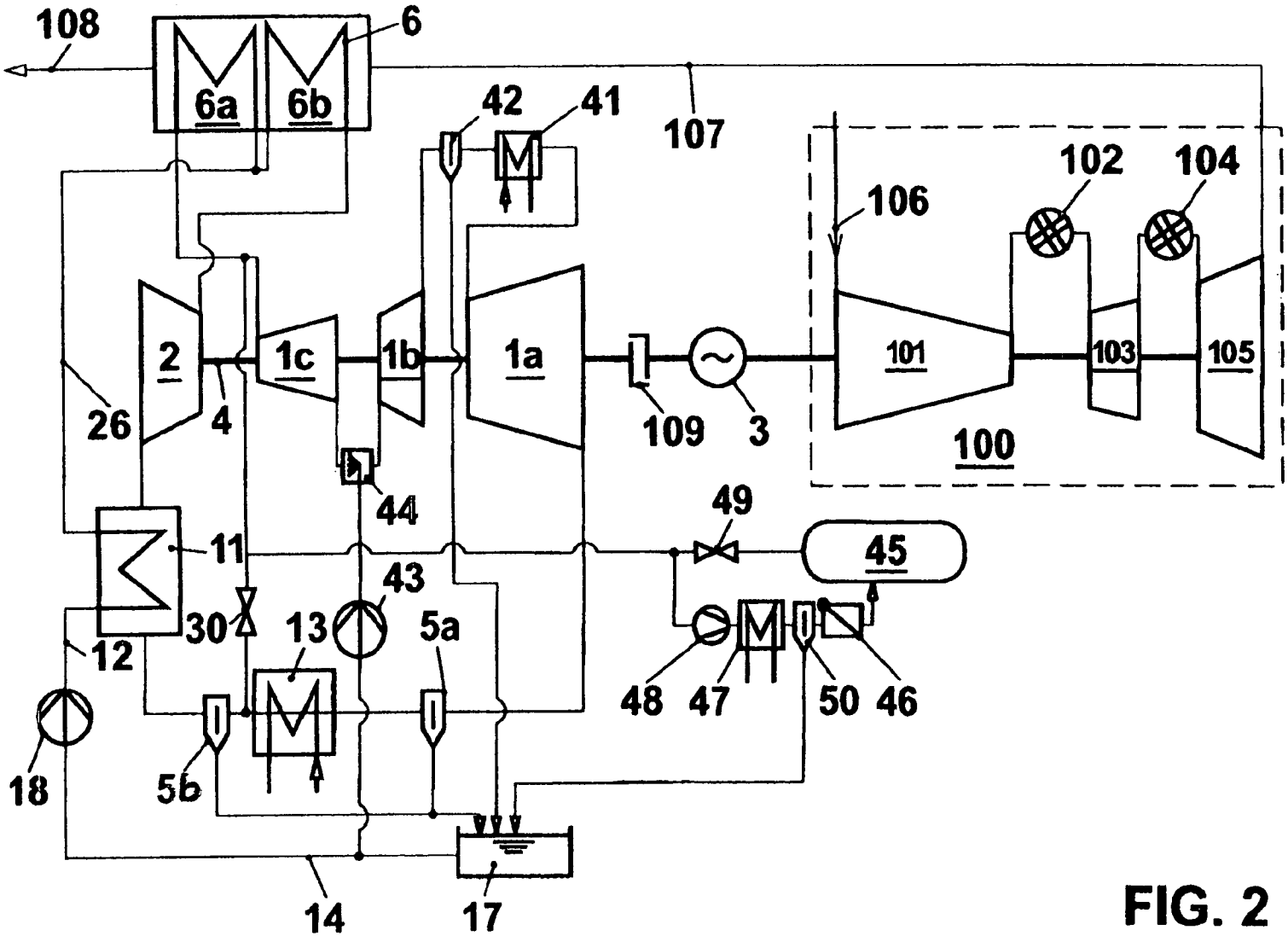
FIG. 2 shows an example for the utilization of the process in accordance with the invention for using the waste heat of an open gas turbine unit.

FIG. 2 shows a power generation unit that uses a power unit according to the invention's process and uses the waste heat of an open gas turbine unit. A gasturbo group 100 drives a generator 3. Without this being a restriction, this is a gasturbo group with sequential combustion as it is well known from EP 620 362 and numerous other publications based on it. Without providing any details, the basic function is briefly described. A compressor 101 and two turbines 103 and 105 are arranged on a mutual shaft. The compressor 101 suctions an amount of air 106 from the environment. Fuel 102 is added to the compressed air in the first combustion chamber and then it is combusted. The flue gas is partially expanded in the first turbine 103, for example with a pressure ratio of 2. The flue gas, which still has a high residual oxygen content of typically 15%, flows into a second combustion chamber 104 where additional fuel is combusted. This reheated flue gas is expanded to approximately ambient pressure in the second turbine 105—apart from pressure losses of the waste gas tract—and flows as hot waste gas 107, with temperatures that range between 550–600° C. with high loads, for example, from the gasturbo group. The flow path of the hot waste gas contains means for using waste heat, heat exchangers 6, in which the waste gas continues to cool before it flows into the atmosphere as cooled waste gas 108. The heat exchanger 6 that is arranged as a means for utilizing waste heat transfers the heat from the waste gas of the open gasturbo group 100 to the cycle of a closed gasturbo unit that operates based on the process in accordance with the invention and that is explained in more detail below. The compressor of the closed gasturbo group that transports a gaseous primary process fluid to an upper process pressure is separated into several partial compressors 1*a*, 1*b*, 1*c* that are connected in series. Downstream from the first compressor an intermediate cooler 41 with a condensate separator 42 is arranged downstream and any condensate that accumulates there is guided into a condensate separator 17. Between the partial compressors 1*b* and 1*c* a spray cooler 44 for further cooling the partially compressed primary process fluid is arranged. If a sufficient amount of liquid is sprayed in, drops penetrate the partial condenser 1*c* and ensure that there is continuous internal cooling. In the interest of efficient waste heat utilization an isothermal compression should be realized to the extent possible. Compressed process fluid flows in reverse flow with waste gas 107, 108 of the open gasturbo group to a first partial heat exchanger 6*a* of the means 6 for utilizing waste heat. Downstream from the first partial heat exchanger 6*a* the primary process fluid is mixed with an amount of steam 26 and together with it flows through the second partial heat exchanger 6*b*. The suitable supply point for the steam 26 is selected based on the temperature so that the steam temperature is not above the temperature of the waste gas from which the heat is to be transferred. The entire fluid amount heated up in the heat exchanger 6*b* flows into a turbine 2 and is expanded using shaft performance. Together with partial compressors 1*a*, 1*b*, 1*c* the turbine 2 is arranged on a mutual shaft 4 and can be coupled with the generator 3 via an automatic coupling 109. One skilled in the art is familiar with this one-shaft design of combination units. The expanded fluid stream from turbine 2 flows into a first heat sink 11 in which the entire fluid stream cools off and at least part of the steam is condensed. The condensate is separated in a first separator 5*a* and fed into a condensate reservoir 17. A second heat sink 13 defines the lower process temperature of the primary process fluid; any resulting condensate is separated in a second separator 5*b* and also fed into the condensate reservoir 17. The dried and cooled process fluid 24 again flows into the first partial compressor 1*a*, which closes the cycle of the primary process fluid. Condensate from the condensate reservoir 17 is supplied from a feed pump 18 as a cooling medium and feed water 12—of course this can be a different fluid other than water in a closed cycle as mentioned above—to the first heat sink 11 that is a steam generator. This is where this feed water is heated, evaporated and at least somewhat overheated using the heat to be dissipated in the first heat sink and is returned to the thermal power cycle as live steam 26. A pump 43 also transports liquid from the condensate reservoir 17 to the spray cooler 44. A shunt valve allows the transfer of process fluid while avoiding turbine 2 and running directly from the high-pressure part to the low-pressure part of the power generation unit, which is necessary for quick load reductions.

Furthermore, a high-pressure reservoir 45 is arranged in connection with the high-pressure part of the closed gasturbo group. In an operating state it is charged by a compressor 48 via a recooler 47, a condensate separator 50 and a check device 46. This charging process removes process fluid from the cycle which causes the pressure level of the entire process, and thus that of the circulating mass flow, to sink. This means with constant pressure ratio and operation of the gasturbo group in or near the starting point it is possible to lower performance. In another operating state the high pressure fluid stored in the reservoir 45 is returned to the cycle via the blocking and throttle device 49 which increases the density of the circulating medium and thus the mass flow and the performance permanently. The feeding of fluid from the high-pressure reservoir 45 has a direct effect as an increase of the turbine mass flow. The energy that is stored in a gas volume can be quickly made available and therefore is suitable for spontaneous performance increases as it might be necessary for supporting the frequency of a network, for example. This is how the performance potential of the closed gasturbo group can be varied easily. These are the main advantages of the power generation unit shown in FIG. 2. If strongly fluctuating waste heat potentials of the open gasturbo group 100 are available, the process that utilizes the waste heat can easily and in a known manner per se be adjusted to the different performance potentials via the pressure level of the overall unit by shifting the process fluid between the fluid circulating in the cycle and in the high pressure reservoir 45. This is also advantageous with regard to the supplied steam 26. If for example, the waste temperature of the gas turbine gas 107 and thus the maximum possible inlet temperature of the turbine 2 sinks, the potential effects could be that excess condensation in the turbine 2 occurs. This also means there is no overheating of the live steam in the steam generator 11. A lowering of the overall pressure of the closed gas turbine process allows for an adjustment in that the steam is sufficiently overheated upon entry into the turbine 2. This is how sliding pressure operation for the steam can be realized in an easy and practical manner. Compared to a pure two-phase process for using waste heat, the waste heat utilization is not quite as good, however, there are significantly more possible uses. In order to achieve good waste heat utilization, the compressor exit temperature of the closed process should be as low as possible. In a gasturbo group that operates based on the process in accordance with the invention this can be advantageously achieved with a relatively low-pressure ratio in a range from approximately 3 to 8 in addition to arranging intermediate coolers. The resulting, comparatively high turbine exit temperature is not significant since the waste heat is recuperated by the waste heat steam generator and is an advantage with regard to the generated steam quality. The performance of a gas turbine process with low pressure ratio that is low compared to the compressor mass flow is offset by the additional steam mass flow that is pushed through turbine 2.

List of Reference Numerals

| | |
|---|---|
| 1 | compression means, compressor |
| 1a, 1b, 1c | compression means, partial compressor |
| 2 | expansion means, turbine |
| 3 | sink, generator |
| 4 | shaft |
| 5 | separator, condensate separator, drop separator, cyclone |
| 5a, 5b | condensate separator |
| 6 | heat exchanger, heat transfer medium, heater |
| 6a, 6b | heat exchanger, partial heat exchanger |
| 7 | combustion medium, burner |
| 8 | heat exchange surface |
| 9 | pre-heater |
| 10 | charger |
| 11 | heat sink, waste heat steam generator |
| 12 | feed water mass flow |
| 13 | heat sink, cooler |
| 14 | condensate |
| 15 | condensate |
| 16 | filter |
| 17 | reservoir, condensate reservoir |
| 18 | feed pump |
| 19 | cooling water |
| 20 | air reservoir |
| 21 | blocking and throttle device |
| 22 | compressor |
| 23 | drain valve |
| 24 | dehumidified process fluid |
| 25 | blocking medium, blocking air |
| 26 | steam |
| 27 | blocking and throttle device |
| 28 | backstream throttle |
| 29 | backstream cooler |
| 30 | shunt device |
| 31 | shaft seal |
| 32 | bleed location for blocking medium of the shaft seals |
| 39 | speed counter measuring location |
| 41 | intermediate cooler |
| 42 | condensate separator |
| 43 | pump |
| 44 | spray cooler |
| 45 | high pressure reservoir, gas reservoir |
| 46 | check device |
| 47 | recooler |
| 48 | compressor |
| 49 | blocking and throttle device |

-continued

| List of Reference Numerals | |
|---|---|
| 50 | condensate separator |
| 100 | gasturbo group |
| 101 | compressor |
| 102 | combustion chamber |
| 103 | turbine |
| 104 | combustion chamber |
| 105 | turbine |
| 106 | air quantity |
| 107 | waste gas |
| 108 | cooled waste gas |
| 109 | coupling |

While the invention has been described in detail with reference to exemplary embodiments thereof, it will be apparent to one skilled in the art that various changes can be made, and equivalents employed, without departing from the scope of the invention. Each of the aforementioned documents is incorporated by reference herein in its entirety.

What is claimed is:

1. A thermal power process comprising:

firstly effecting a first thermodynamic change of state of a process fluid from a first thermodynamic state to a second thermodynamic state, including compressing the process fluid;

secondly effecting a second thermodynamic change of state of the process fluid from the second thermodynamic state to a third thermodynamic state including supplying heat to the compressed process fluid, with the heat being supplied indirectly by a heat exchange process;

thirdly effecting a third thermodynamic chance of state of the process fluid from the third thermodynamic state to a fourth thermodynamic state, including expanding the process fluid;

fourthly effecting a fourth thermodynamic change of state of the process fluid from the fourth thermodynamic state to the first thermodynamic state, including dissipating heat from the expanded process fluid in at least one heat sink;

completely returning the process fluid to the compression process such that the process fluid is guided in a completely closed cycle without undergoing a phase change;

introducing an amount of steam into the process fluid;

expanding said amount of steam together with the compressed process fluid;

substantially condensing said steam in one of said at least one heat sink;

separating said condensed steam as condensate from the process fluid;

evaporating said condensate;

introducing the steam resulting from said evaporating into the process fluid;

wherein said evaporating of the condensate occurs with heat dissipated from one of the at least one heat sink, wherein an amount of steam is generated with live steam pressure, and wherein said amount of steam is added to the completely compressed process fluid prior to said expanding.

2. A thermal power process in accordance with claim 1, further comprising at least one additional heat dissipation in at least one additional heat sink.

3. A thermal power process in accordance with claim 1, comprising:

bringing the condensate to a live steam pressure;

using the condensate as a cooling agent in the one of the at least one heat sink; and using the condensate for generating steam.

4. A thermal power process comprising:

firstly effecting a first thermodynamic change of state of a process fluid from a first thermodynamic state to a second thermodynamic state, including compressing the process fluid;

secondly effecting a second thermodynamic change of state of the process fluid from the second thermodynamic state to a third thermodynamic state including supplying heat to the compressed process fluid, with the heat being supplied indirectly by a heat exchange process;

thirdly effecting a third thermodynamic chance of state of the process fluid from the third thermodynamic state to a fourth thermodynamic state, including expanding the process fluid;

fourthly effecting a fourth thermodynamic change of state of the process fluid from the fourth thermodynamic state to the first thermodynamic state, including dissipating heat from the expanded process fluid in at least one heat sink;

completely returning the process fluid to the compression process such that the process fluid is guided in a completely closed cycle;

introducing an amount of steam into the process fluid;

expanding said amount of steam together with the compressed process fluid;

substantially condensing said steam in a first heat sink of said at least one heat sink;

separating said condensed steam as condensate from the process fluid;

evaporating said condensate;

introducing the steam resulting from said evaporating into the process fluid;

wherein said evaporating of the condensate occurs with heat dissipated from said first heat sink, wherein an amount of steam is generated with live steam pressure, and wherein said amount of steam is added to the completely compressed process fluid prior to said expanding;

adding at least a fraction of the steam to the process fluid prior to providing heat; and providing heat to said steam fraction together with the process fluid.

5. A thermal power process in accordance with claim 1, comprising:

cooling the process fluid during the first thermodynamic change of state from the first thermodynamic state to the second thermodynamic state.

6. A thermal power process in accordance with claim 1, comprising:

providing heat to the process fluid during the third thermodynamic change of state from the third thermodynamic state to the fourth thermodynamic state.

7. A thermal power process in accordance with claim 1, wherein the pressure of the process fluid is more than 5 bar for the first thermodynamic state and the fourth thermodynamic state.

8. A thermal power process in accordance with claim 1, comprising:

adding at least a fraction of the steam during the third thermodynamic change of state from the third thermodynamic state to the fourth thermodynamic state.

9. A device useful for carrying out a thermal power process according to claim 1, the device comprising:

at least one compression means for effecting the thermodynamic change of state from the first thermodynamic state to the second thermodynamic state;

means for providing heat including a heat exchanger, though which heat exchanger the process fluid can flow on a secondary side, said means for providing heat arranged downstream from the at least one compression means;

at least one expansion means arranged downstream from the means for providing heat;

at least a first heat sink of said at least one heat sink arranged downstream from the at least one expansion means;

means for guiding process fluid from the at least first heat sink to the at least one compression means;

a steam generator;

means for introducing steam from the steam generator into the process fluid arranged downstream from the compression means and upstream from at least one of said at least one expansion means;

means for separating resulting condensate from the process fluid;

means for flowing the condensate to the steam generator;

wherein the at least first heat sink is substantially identical to the steam generator; and wherein the steam generator is configured and arranged for receiving the process fluid on a primary side and flowing the process fluid therethrough.

10. A device in accordance with claim 9, comprising:

at least a second heat sink arranged in the flow path of the process fluid downstream from the steam generator.

11. A device in accordance with claim 9, wherein the compression means comprises at least one intercooler for the process fluid.

12. A device useful for carrying out a thermal power process, the device comprising:

at least one compression means for effecting a thermodynamic change of state from a first thermodynamic state to a second thermodynamic state;

means for providing heat including a heat exchanger, though which heat exchanger the process fluid can flow on a secondary side, said means for providing heat arranged downstream from the at least one compression means;

at least one expansion means arranged downstream from the means for providing heat;

at least a first heat sink arranged downstream from the at least one expansion means;

means for guiding process fluid from the at least first heat sink to the at least one compression means;

a steam generator;

means for introducing steam from the steam generator into the process fluid arranged downstream from the compression means and upstream from at least one of said at least one expansion means;

means for separating resulting condensate from the process fluid;

means for flowing the condensate to the steam generator;

wherein the heat sink is substantially identical to the steam generator;

wherein the steam generator is configured and arranged for receiving the process fluid on a primary side and flowing the process fluid therethrough; and means for introducing liquid drops into the process fluid that flows though the compression means.

13. A device in accordance with claim 9, wherein said at least one expansion means comprises at least two expansion means; and comprising:

at least one additional means for supplying heat to the process fluid arranged in or between said at least two expansion means.

14. A device in accordance with claim 9, wherein the at least one expansion means comprises at least one power engine for expanding the process fluid and at least a fraction of the steam while providing useful work; and comprising the power engine being arranged and adapted to drive at least one of at least one working engine as a compression means or a power consumer, or both.

15. A device in accordance with claim 9, further comprising at least one common shaft wherein each working engine arranged as a compression means is arranged on the common shaft with at least one expansion means arranged as a power engine.

16. A device in accordance with claim 9, wherein said means for providing heat to the fluid comprises a heat exchanger though which the waste gas of a gas turbo group can flow on a primary side.

17. A device in accordance with claim 9, further comprising:

a heat generator; and wherein said means for providing heat to the fluid comprises a heat exchanger though which the process fluid can flow on a secondary side, and including a primary side fluidly connected to said heat generator.

18. A device in accordance with claim 9, wherein the heat generator comprises a supercharged combustion device.

19. A device in accordance with claim 9, comprising:

means for varying the mass flow of the circulation process fluid;

wherein the cycle of the process fluid is connected to said means for varying the mass flow.

20. A device in accordance with claim 9, comprising:

means for introducing steam arranged in the process fluid flow path upstream from the means for providing heat.

21. A device in accordance with claim 9, comprising:

a blocking or throttle shunt line arranged downstream from the compression means.

22. A device in accordance with claim 9, wherein the at least one compression means comprises a turbo compressor.

23. A device in accordance with claim 9, wherein said at least one expansion means comprises a turbine.

24. A device useful for carrying out a thermal power process, the device comprising:

at least one compression means for effecting a thermodynamic change of state from a first thermodynamic state to a second thermodynamic state;

means for providing heat including a heat exchanger, through which heat exchanger the process fluid can flow on a secondary side, said means for providing heat arranged downstream from the at least one compression means;

at least one expansion means arranged downstream from the means for providing heat;

at least a first heat sink arranged downstream from the at least one expansion means;

means for guiding process fluid from the at least first heat sink to the at least one compression means;

a steam generator;

means for introducing steam from the steam generator into the process fluid arranged downstream from the at least one compression means and upstream from at least one of said at least one expansion means;

means for separating resulting condensate from the process fluid;

means for flowing the condensate to the steam generator;

wherein the at least first heat sink is substantially identical to the steam generator; and wherein the steam generator is configured and arranged for receiving the process fluid on a primary side and flowing the process fluid therethrough; and a gas turbo group with a closed cycle including a gas turbine and a heat recovery steam generator arranged downstream from the gas turbine, for generating a steam mass flow therein, a feedpump configured and arranged to flow condensate to the heat recovery steam generator, and means for introducing at least a fraction of the steam produced in the heat recovery steam generator into the process fluid of the gas turbine upstream from the gas turbine.

25. A device according to claim 24, comprising:

a supplemental heat sink for defining a lower process temperature arranged downstream of the heat recovery steam generator.

26. A power generation plant comprising:

a gas turbo group including at least one open cycle configured and arranged to generate waste heat; and at least one thermal power engine configured and arranged to perform a thermal power process according to claim 1 arranged for using the waste heat of the gas turbo group.

27. A thermal power process in accordance with claim 7, wherein the pressure of the process fluid is between 5 bar and 10 bar for the first thermodynamic state and the fourth thermodynamic state.

* * * * *